United States Patent [19]

Coburn

[11] 4,134,668

[45] Jan. 16, 1979

[54] APPARATUS FOR IMAGE REPRODUCTION AND IMAGE CREATION

[75] Inventor: Richard J. Coburn, West Hartford, Conn.

[73] Assignee: Coburn Technology, Inc., East Hartford, Conn.

[21] Appl. No.: 788,353

[22] Filed: Apr. 18, 1977

Related U.S. Application Data

[63] Continuation-in-part of Ser. No. 620,947, Oct. 9, 1975, abandoned.

[51] Int. Cl.[2] ..... G03G 15/00

[52] U.S. Cl. ..... 355/3 R; 346/160; 346/110 R; 355/20; 358/300

[58] Field of Search ..... 355/3 R, 1, 16, 20, 355/46; 346/158, 160, 110 R; 358/300

[56] References Cited

U.S. PATENT DOCUMENTS

| | | | |
|---|---|---|---|
| 2,842,610 | 7/1958 | Crosfield et al. | 358/80 |
| 3,473,455 | 10/1969 | Schoenthal | 358/300 X |
| 3,681,527 | 8/1972 | Nishiyama et al. | 358/300 X |
| 3,845,239 | 10/1974 | Granzow et al. | 358/300 X |
| 3,890,038 | 6/1975 | Ichikawa | 355/1 |

*Primary Examiner*—Richard L. Moses
*Attorney, Agent, or Firm*—Donald J. Hayes

[57] ABSTRACT

Combined copying and printing apparatus is provided by combining a known office copier of the plain paper transfer type with a non-impact printer that uses a black on white cathode ray tube optical display to form a latent electrostatic image on the photoreceptor of the copier apparatus. The cathode ray tube may be fixed or movable, as required, and is of the single sweep type using fiber optics to transmit the optical image to the photoreceptor, which photoreceptor moves relative to the CRT sweep to provide a two-dimensional image that is developed and transferred to plain paper. The non-impact printer of the invention can be used as a stand-alone device without provision for the copying function.

15 Claims, 7 Drawing Figures

APPARATUS FOR IMAGE REPRODUCTION AND IMAGE CREATION

This application is a continuation in part of applicant's co-pending application Ser. No. 620,947, now abandoned file Oct. 9, 1975.

This invention relates to electrophotographic copying and non-impact printing systems and is more particularly directed to the provision of combination apparatus which will operate either as a plain paper office-type copying machine or a high-speed non-impact line printer as well as provision of a stand-alone high speed non-impact printer.

The basic apparatus of the invention is a transfer process copying machine of a commercially available type wherein a scanning shuttle moves across the item to be copied for transmission of the image to a photoreceptor so as to establish a latent electrostatic image thereon which is thereafter developed and transferred through conventional techniques to plain paper. In addition to the basic copying apparatus, the present invention provides a character generator system that includes a cathode ray tube with appropriate control electronics to establish on the face of the tube an image wherein the background is bright and the information to be printed is dark. That optical information is coupled in a line-by-line manner to the surface of the photoreceptor through utilization of fiber optics, relative movement of the photoreceptor and the fiber optics serving to produce the desired two-dimensional optical image on the photoreceptor so as to create a latent electrostatic image in a manner similar to that of the copying mode of operation, which electrostatic image is thereafter developed and transferred to plain paper. It is essential of course that the copy function and printing function be mutually compatible and it is therefore a principal object of this invention to provide apparatus which accomplishes such a combination with a minimal intrusion into the existing function of the apparatus when operating in the copy mode.

It is also a principal object of this invention to provide apparatus which combines a high-speed non-impact printer with a conventional office-type copier so as to provide a comparatively low cost versatile machine for general business use.

It is a further object of this invention to provide combined apparatus for both image reproduction and image creation wherein utilization is made of common functional apparatus in the standard copying machine such that only minimal additional apparatus is necessary to provide a high-speed non-impact printer with minimal intrusion into the basic copy machine function.

It is a still further object of this invention to provide a high-speed non-impact printer utilizing electrophotographic techniques.

Other objects will be in part obvious and in part pointed out more in detail hereinafter.

A better understanding of the objects, advantages, features, properties and relationships of this invention will be obtained from the following detailed description and the accompanying drawing which set forth an illustrative embodiment and are indicative of the ways in which the principles of this invention are employed.

Figure 1:
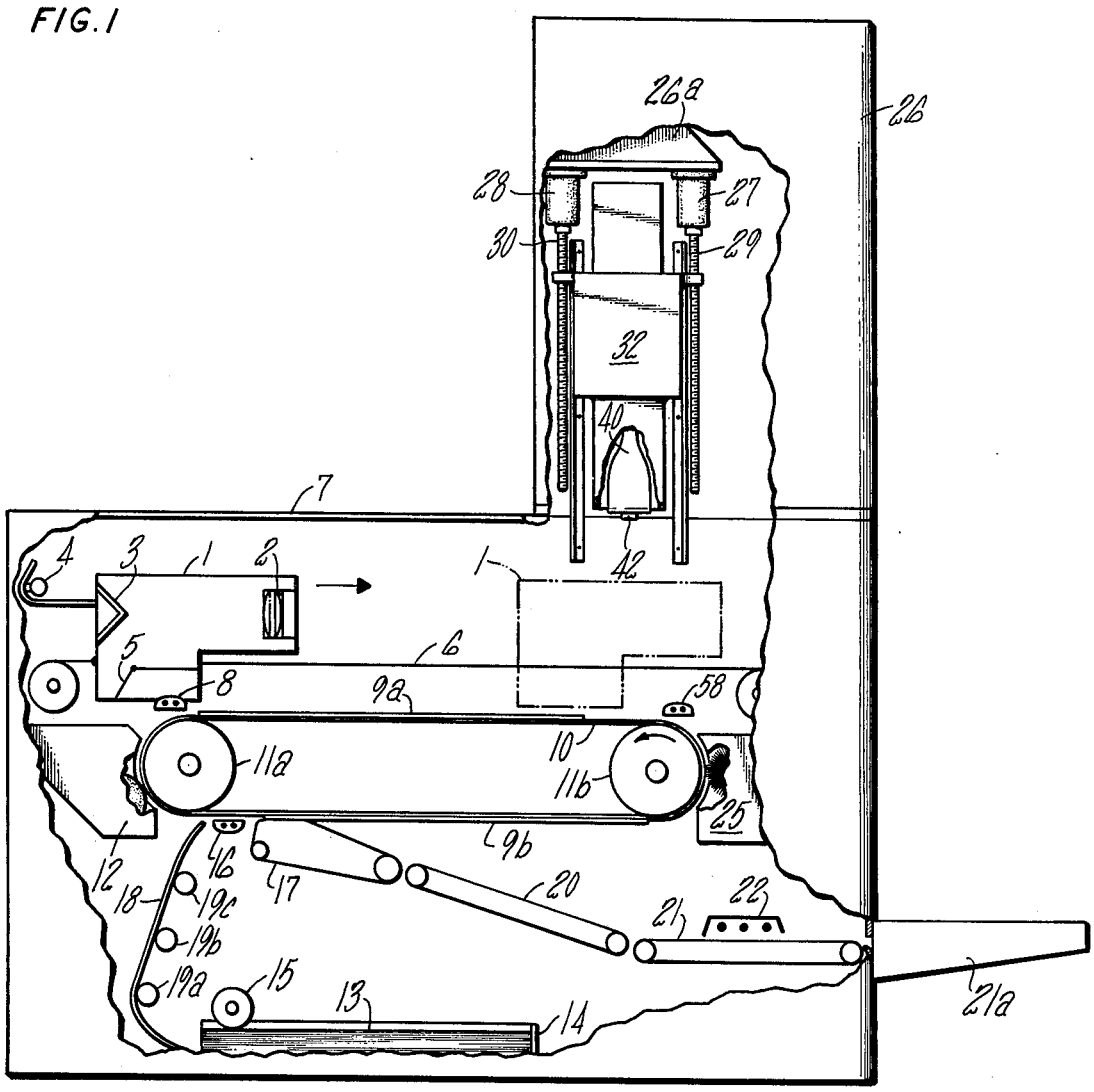
FIG. 1 is a schematic illustration of one embodiment of the invention arranged for operation in the copy mode.

Turning first to FIG. 1 which schematically illustrates one form of the invention arranged for operation in the copy mode, it should be noted that the basic copy apparatus utilized in this embodiment is apparatus known commercially as the Royal copier Model RBC-1, which apparatus is shown and described in U.S. Pat. No. 3,792,294 issued Feb. 19, 1974 and assigned on its face to Konishiroku Photo Industry, Co., Ltd. Tokyo, Japan and the disclosure of that patent is incorporated herein by reference. It should be understood however that this invention can be applied to various types of commercially available office-type copying apparatus without departing from the present invention.

Referring now to the details of FIG. 1 wherein the numbers selected for common parts of the apparatus are intended to be identical to the numbers utilized in the aforementioned patent so as to simplify understanding thereof, the copying system includes an optical system having a support frame 1 and an in-mirror-lens 2 which acts to reverse the lateral relationship of the image. A reflecting mirror 3 assists in transferring the image which is illuminated by lamp 4 from the original to be copied on the receptacle 7, a diaphragm 5 being provided to control the amount of light. Disposed on the bottom of the support frame is a corona discharger 8, the path of movement of frame 1 being substantially parallel and adjacent to endless belt 10 which runs around rollers **11*a* and 11*b* and which supports a light sensitive element 9*a* and 9*b*. That light sensitive element can be a paper of a type described in the aforementioned patent or can be any suitable photo-sensitive or light-sensitive material known in the art. Along the path of movement of the photoreceptors 9*a* and 9*b* are disposed in turn a developing unit 12, a corona discharger 16 for transfer purpose, a transfer separation unit 17 and a cleaner unit 25. A stack of transfer paper 13 is stored in a container 14 and a rotatable roller 15 removes the paper 13 from the container 14 in a sheet-by-sheet manner, each sheet of the paper being guided by a guide plate 18 and fed by rollers 19*a*, 19*b* and 19*c* to a transfer position wherein it is held in contact with the photoreceptor 9*a* or 9*b* as the latter moves with the belt 10. Thereafter the transfer paper is separated from the photoreceptor by transfer paper separation unit 17 and is fed on feed belts 20 and 21, arranged in cascade, to be removed from the system. Above the feed belt 21 is located a fixing unit 22 which "fixes" the image on the paper 13 before it is ejected to the tray 21*a***.

The operation of the copy portion of the apparatus is substantially the same as set forth in the aforementioned patent. The photoreceptor **9*a* is uniformally charged while the belt 10 remains stationary and thereafter is exposed to the image transferred by movement of optical system frame 1 in the direction indicated by the arrow which movement is controlled by the illustrated drive and pulley system 6. The lamp 4 and the corona discharger 8 are energized during this movement such that the charging is followed by the optical image exposure to produce a latent electrostatic image on the photoreceptor 9***a*. The termination of the charging and exposure is indicated by the position of the frame 1 shown in broken lines thereafter belt 10 moves in the direction indicated by the corresponding arrow. During the movement of the belt 10 the photoreceptor 9*a* passes by the developing unit 12, the transfer corona discharger 16, the separation unit 17 and the cleaner 25 in sequence. As belt 10 moves, the optical frame 1 is moved in the opposite direction to return it to its original or starting position shown in solid lines. Transfer paper is supplied and fed in synchronism with the movement of the belt 10 so as to be superimposed upon the photoreceptor 9*a* at the transfer position. After transfer of the image, the paper 13 is separated from the photoreceptor by separation unit 17 and is conveyed on belts 20 and 21 to be subjected to fixation of the transferred image by the fixing unit 22 whereafter it is displaced from the system.

The printing or image formation apparatus forming a part of this invention, while it is non-functional and does not interfere with the operation of the apparatus during the printing mode is nonetheless part of the main apparatus. However because the apparatus of FIG. 1 endeavors to use the existing office copier, it is apparent that movement of the optical frame 1 from its rest position to its dashed line position effectively occupies the entire area above the belt 10. Accordingly the main image formation apparatus is supported on frame 26*a* which in turn is supported on and above the main copy machine frame in any suitable manner and enclosed by a housing 26. A portion of the housing 26 is shown broken away to disclose that frame 26*a* includes a pair of drive motors 27 and 28 connected to lead screws 29 and 30 which support and control the motion of print-head 32 by appropriate energization of the motors, the print-head 32 can be lowered into effective optical or light transmitting relationship with the photoreceptor as hereinafter disclosed. Other suitable means to control print head position can of course be used.

Print-head 32 is shown partially broken away to disclose that it encloses and supports a cathode ray tube 40 of a conventional type having a fiber optic face plate 42 secured thereto in intimate light conducting relationship. In normal copy machine usage of the apparatus the print-head is retained in its elevated position, does not interfere with the work loading platen 7 and does not otherwise affect the operation and control of the copy apparatus.

The cathode ray tube used in this invention is of the type sold commercially by many companies including Litton Industries and Thomas Electronics, Inc. and is of the type having a narrow bundle of fiber optic elements forming a face plate extending across the horizontal dimension of the tube. Such cathode ray tubes are standard items of commerce and it is believed that no further disclosure is necessary except to point out that such a tube is of the type having a single line sweep such that vertical deflection of the beam is not required except as may be desirable for adjustment of the location of the sweep line during use of the apparatus.

Figure 4:
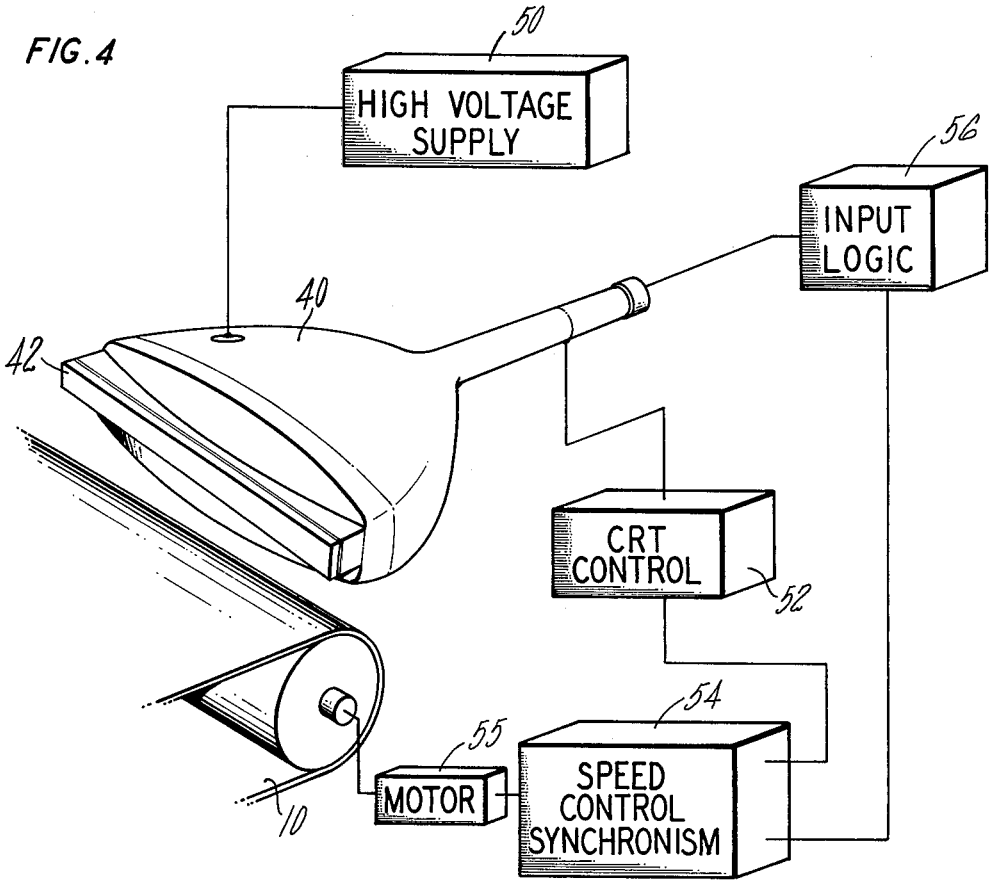
FIG. 4 is a block diagram showing basic electrical and control functions.

The basic control functions necessary of cathode ray tube 40 used in the present invention and its control can best be seen by referring to FIG. 4 wherein it is seen that the cathode ray tube is provided with a conventional high-voltage power supply 50. A suitable control circuit 52 which supplies and controls the focus and horizontal sweep functions of the cathode ray tube (as well as vertical deflection adjustment) and a speed control synchronizing circuit 54 which controls the energization of the drive motor 55 for driving the endless belt 10 in the printing mode. The energization and de-energization of the beam of the cathode ray tube is controlled by the desired input logic circuit 56 which for the present purposes of description need only be a circuit, appropriately controlled, to turn the cathode ray tube beam on and off as desired.

Figure 2:
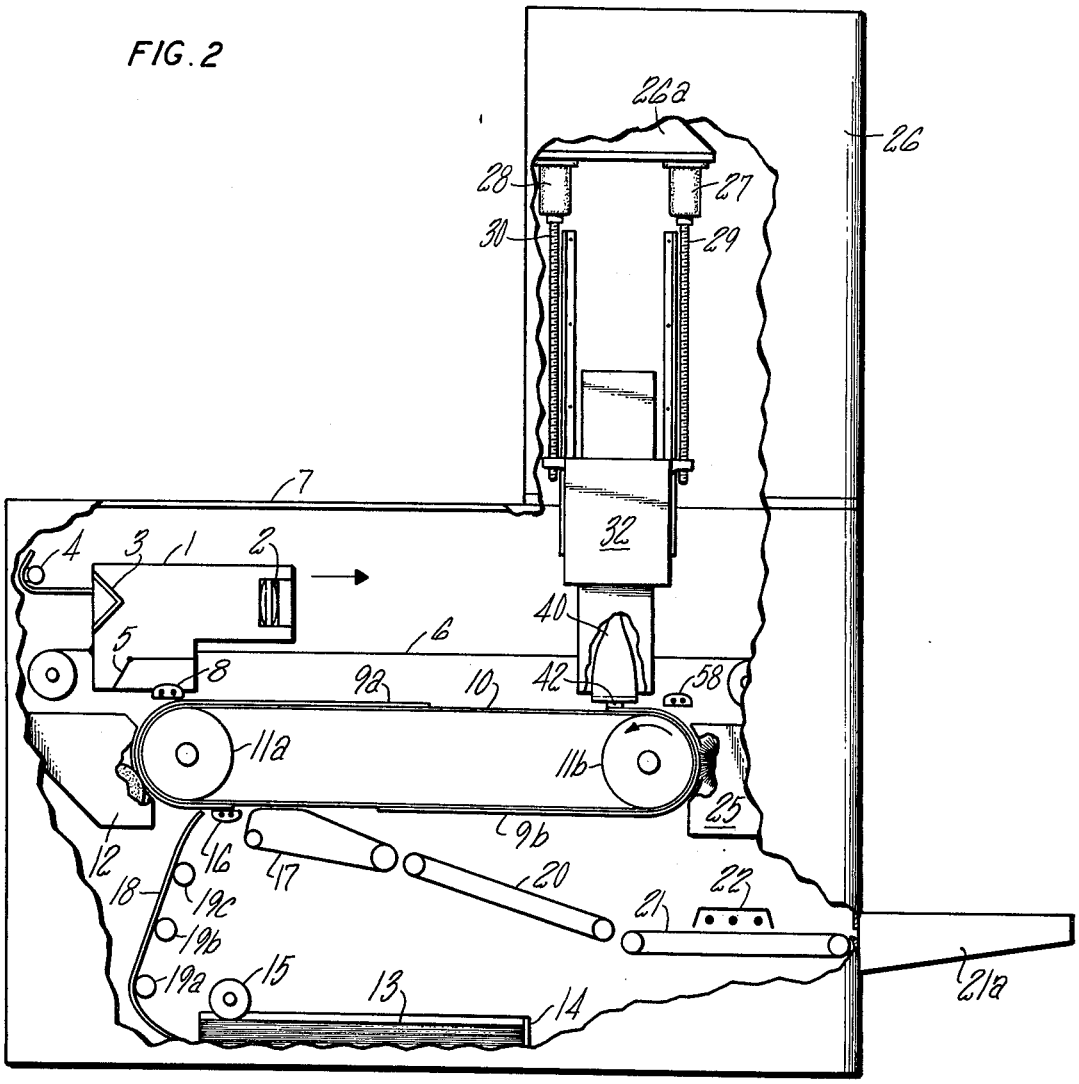
FIG. 2 is a schematic illustration of one embodiment of the invention arranged for operation in the print mode.
Figure 3:
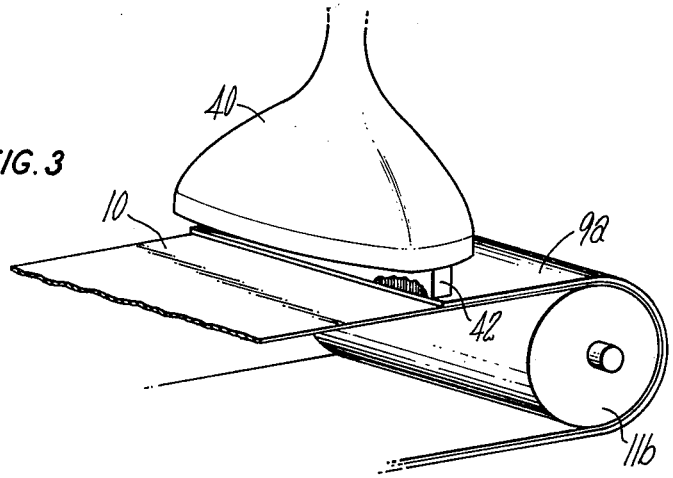
FIG. 3 is a perspective view of a portion of the apparatus showing certain details of the non-impact printer.

Referring now to FIGS. 2 and 3, upon initial energization of the apparatus of this invention to function in the print mode, it is necessary to energize the motors 27 and 28 to lower the print-head 32 into the position shown in FIG. 3 wherein the fiber optic face plate 42 is in effective light conducting relationship with the photoreceptor 9*a*. By appropriate control circuitry, not shown, the drive motor for the optical support frame 1 is disabled from further operation when the desired print-head photoreceptor relationship is established (by conventional circuitry not shown) and the drive to endless belt 10 is placed under the control of the speed control circuit 54.

In its lowered position, best seen in FIG. 3 the cathode ray tube face plate 42 is brought into intimate engagement with the photoreceptor 9*a* supported on endless belt 10. That face plate is, in the preferred embodiment, a bundle of fiber optic elements which engage the photoreceptor 9*a* to ensure effective transmission of the light information displayed on the face of the cathode ray tube to the photoreceptor 9*a*. Moreover the fiber optic face plate may be in actual contact with the photoreceptor although the nature and extent of such contact will depend to a large extent upon the type of material utilized for the photoreceptor 9*a*, the shape of the photoreceptor (drum or flat sheet) and of course some type of additional support (not shown) may be necessary to be provided to control the extent of contact between the photoreceptor and the fiber optic face plate 42.

Because the optical frame 1 is disabled (stationary) in the print or image generation mode, it is necessary to provide an additional corona device which cooperates with the photoreceptors 9*a* and 9*b* during the print mode. Such a corona device, shown schematically at 58 provides the desired photoreceptor charge at a point just preceding the print-head to properly sensitize the photoreceptor prior to receiving optical information from the cathode ray tube, much as provided by corona device 8 in the copy mode.

In accordance with a principal feature of the present invention, the cathode ray tube utilized in the present invention utilizes only a single scan line and provides image reversal insofar as the photoreceptor is concerned. That is, when it is desired to provide optical information to the face of the cathode ray tube, the input logic circuit 56 serves to turn off the CRT beam thereby to provide a black "spot". Successive horizontal sweeps or scan lines of the cathode ray tube, when transferred to the moving photoreceptor, create a latent electrostatic image which has the same characteristics as would be obtained from a traditional black on white background original such as would be copied by the machine when operating in the copy mode. Stated somewhat differently, it should be understood that when using a single scan line, it is necessary to move the photoreceptor past the face plate of the CRT in order to achieve the vertical dimension of the information to be received on the photoreceptor and that information will be in the form of a "positive", i.e. black on a white background. Thus a two-dimensional black on white image is provided, the lateral dimension being provided by the horizontal sweep of the cathode ray tube and a vertical dimension being supplied by the moving photoreceptor as it passes the face of the tube.

Figure 5:
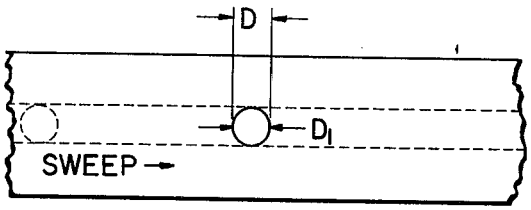
FIG. 5 is a schematic diagram of CRT beam width.
Figure 6:
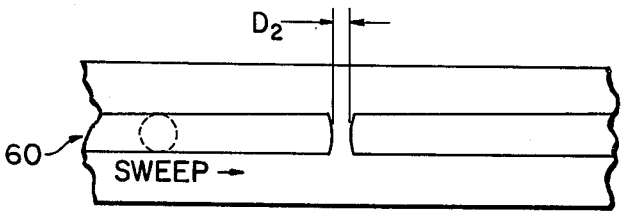
FIG. 6 is a schematic diagram of the CRT of the present invention showing character formulation; and, FIG. 7 is a schematic illustration of another embodiment of the invention arrangement for operation as a stand-alone printer.

Further in accordance with said principal feature, the present apparatus has the advantage of providing a line thickness (during character formulation) which is more narrow than that which can be easily obtained by the conventional technique of energizing the CRT beam when it is desired to display information. Referring to FIG. 5, there is schematically disclosed a portion of a CRT face which illustrates that the minimum line width D displayed on the CRT face is determined by CRT beam or spot width $D_1$ in the conventional arrangement wherein the CRT beam is turned "on" and then "off" by suitable control circuitry. Turning next to FIG. 6 which schematically illustrates a portion of the CRT face of the present invention, the beam 60 is continuously energized during its sweep across the CRT except when it is desired to display information. Thus, the minimum line width $D_2$ is determined by beam "off" time, which time variable permits display of black information on a white background and, thus, that spot of information may be much more narrow than the beam width $D_1$. It is also recognized that such a black on white display, because it uses a beam which is "on" most of the time and "off" only momentarily, reduces the magnitude of cumulative beam current change and thus permits significant simplification of the CRT power supply by simplifying the power regulation problems for the high voltage portion of that power supply.

It is of course necessary to synchronize the speed of the moving photoreceptor with the sweep speed of the CRT, its beam fly back time, etc. It has been found that the speed of movement of the photoreceptor can be, if desired, increased many times over the speed of the photoreceptor as used in the copy mode of the apparatus.

Figure 7:
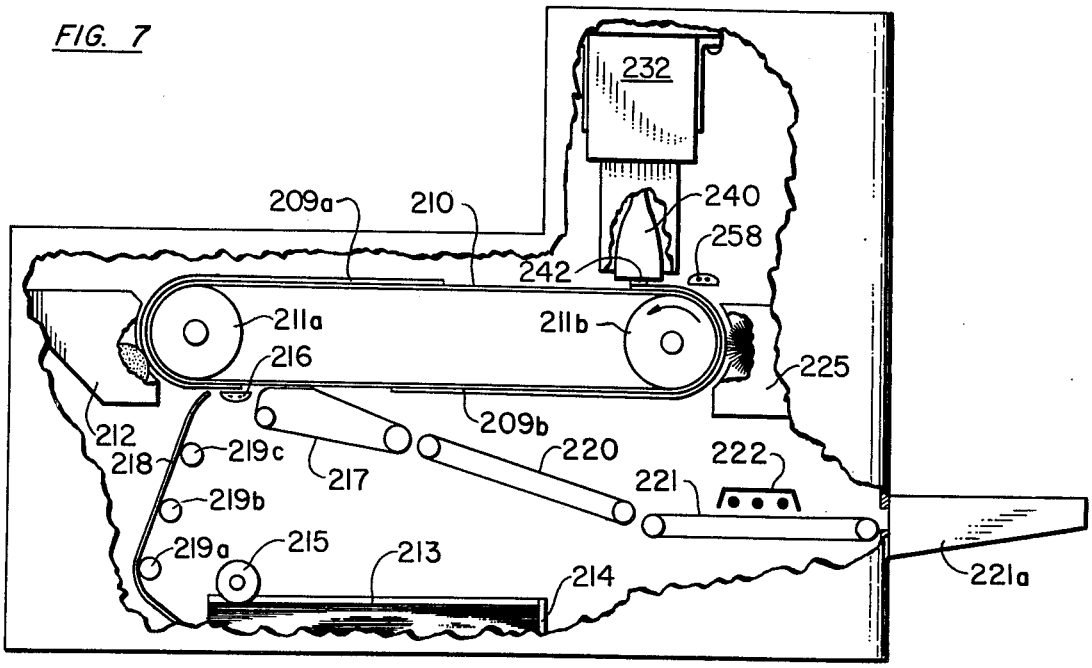

While the apparatus of this invention has principal utility as combined apparatus for image reproduction and image creation, significant advantages are obtained by using that portion of the combination apparatus used for image creation as a stand-alone printer having separate utility where only a printing function is needed. FIG. 7 discloses such printing apparatus which is identical in all significant respects with the combined apparatus with the exception that the optical system for copying documents is eliminated as is the apparatus for raising and lowering the print-head.

In FIG. 7, wherein like parts have been accorded like numbers with the prefix "2", print-head 232 is maintained in position with the fiber optic face plate 242 of CRT 240 in effective light conducting relationship with the photoreceptor 209*a*. The control of the apparatus is identical to that discussed with FIG. 4 such that light information from CRT 240 is conveyed through face plate 242 to photoreceptor 209*a* (supported on belt 210) as it moves in the direction shown at roller 211*b*, the receptors 209*a* and 209*b* being charged by corona device 258. The latent electrostatic image on the photoreceptor (as that photoreceptor moves with belt 210) passes by developing unit 212, the transfer corona discharger 216, the separation unit 217, and the cleaner 25 in sequence. Transfer paper is supplied and fed in synchronism with the movement of belt 210 so as to be superimposed upon the photoreceptor 209*a* at the transfer position. After transfer of the image, the paper 213 is separated from the photoreceptor by separation unit 217 and is conveyed on belts 220 and 221 to be subjected to fixation of the transferred image by the fixing unit 222 whereafter it is displaced from the system. The utilization of such a single line, black on white, CRT image permits low cost, high speed printing of data supplied to the control circuit of the CRT.

A further embodiment of the invention is similar to that shown in the drawings but is not illustrated. That modification permits the cathode ray tube (and related apparatus) to be fixed in position either through utilization of modified fiber optics or utilization of a modified copier machine or both. In some copy machines it is necessary that the photoreceptor have a relatively unimpeded surface for use during the copy mode of operation so that effective transfer of the copy image can be achieved. In one aspect of this embodiment the fiber optic coupler can be flexible and is movably supported relative to the photoreceptor so that the cathode ray tube may be supported in fixed relationship to the photoreceptor and in such position remote from such apparatus as may be desired.

If machine design considerations permit, the belt 210 of the present disclosure may be lengthened so as to accommodate a fixed print-heat and cathode ray tube immediately adjacent the photoreceptor, such as shown in FIG. 2, while accommodating the full normal travel of the optical frame 1. Such an arrangement may however require some redesign of the basic copier apparatus, at least insofar as dimensions are concerned.

There are many other accessories for the present apparatus which have not been shown largely because of their conventional nature. The data input shown in the block diagram can of course be data received from any suitable source, which information may be appropriately coded so as to activate logic circuits that control the de-energization of the beam of the cathode ray tube to transmit that information to the photoreceptor by de-energization of the beam. Additionally the various conventional control functions have not been illustrated although it should be understood that through utilization of conventional circuit techniques the machine can be interlocked and controlled so that only very modest control functions are necessary for the operator.

It will therefore be seen that the present invention provides basic apparatus for both copying existing documents as well as printing documents in a non-impact manner from a suitable data source; such apparatus, because it utilizes basic transfer copy techniques permits relatively facile modification of existing copy apparatus to provide a low cost, easy to use combined copier/-printer susceptible of general business office use.

The utilization of basic transfer copy techniques with applicant's improved CRT printer also provides a low cost, easy to use stand-alone printer susceptible of general business office use.

As will be apparent to persons skilled in the art, various modifications, adaptations and variations of the foregoing specific disclosure can be made without departing from the teachings of the present invention.

I claim:

1. Combination apparatus for image reproduction and image creation comprising a photoreceptor for receiving an electrostatic charge and for forming an electrostatic image upon being exposed to a light image, means for applying a developing substance to said photoreceptor after said electrostatic image has been formed and for transferring the developed image to paper and fixing it thereon, first means for transmitting a light image to said photoreceptor, said image being a reproduction of the object to be copied, second means for transmitting a light image to said photoreceptor upon disabling of said first means, said second means being selectively movable from a remote inoperative position, permitting use of the apparatus for image reproduction unimpeded by said first means, into effective light transmitting relationship with said photoreceptor and including a cathode ray tube light source.

2. The apparatus of claim 1 wherein said second means comprises a cathode ray tube light source and fiber optic face plate which are movable from said first inoperative position remote from said photoreceptor during use of the apparatus for image reproduction to a second position wherein said fiber optics are in effective light transmitting relationship with said photoreceptor during use of the apparatus for image creation.

3. Combination apparatus for image reproduction and image creation comprising a photoreceptor for receiving an electrostatic charge and for forming an electrostatic image upon being exposed to a light image, means for applying a developing substance to said photoreceptor after said electrostatic image has been formed and for transferring the developed image to paper and fixing it thereon, first means for transmitting a light image to said photoreceptor, said image being a reproduction of the object to be copied, second means for transmitting a light image to said photoreceptor upon disabling of said first means, said second means being selectively movable into effective light transmitting relationship with said photoreceptor and including a cathode ray tube light source and control means for said cathode ray tube for causing selective de-energization of the cathode ray tube beam to form a black on white tube face image for transmission to said photoreceptor.

4. The apparatus of claim 3 wherein the beam of said cathode ray tube sweeps across the face of said tube in a single line and means are provided for moving said photoreceptor in a direction generally perpendicular to the sweep line thereby to provide a two-dimensional light image on said photoreceptor.

5. Combination apparatus for image reproduction and image creation comprising a photoreceptor for receiving an electrostatic charge and for forming an electrostatic image upon being exposed to a light image, means for developing said electrostatic image and for transferring the developed image to paper and fixing it thereon, first means for transmitting a light image to said photoreceptor, said image being a reproduction of the object to be copied, second means for transmitting a light image to said photoreceptor, said second means being in effective light transmitting relationship with said photoreceptor and including a cathode ray tube light source, and control means for said cathode ray tube to cause selective de-energization of the cathode ray tube beam to form a black on white tube face image for transmission to said photoreceptor.

6. The apparatus of claim 5 wherein the beam of said cathode ray tube sweeps across the face of said tube in a single line and means are provided for moving said photoreceptor in a direction generally perpendicular to the sweep line thereby to provide a two-dimensional light image on said photoreceptor.

7. The apparatus of claim 6 wherein fiber optic light transmitting means are secured in intimate light transmitting relationship with said cathode ray tube and are in effective light transmitting relationship with said photoreceptor.

8. The apparatus of claim 5 wherein said second means comprises a cathode ray tube light source and fiber optic face plate which are movable from a first position remote from said photoreceptor during use of the apparatus for image reproduction to a second position wherein said fiber optics are in effective light transmitting relationship with said photoreceptor during use of the apparatus for image creation.

9. The apparatus of claim 8 wherein the beam of said cathode ray tube sweeps across the face of said tube in a single line and means are provided for moving said photoreceptor in a direction generally perpendicular to the sweep line thereby to provide a two-dimensional light image on said photoreceptor.

10. The apparatus of claim 5 wherein said photoreceptor comprises a sheet mounted on an endless belt for movement relative to said second means for transmitting a light image to said photoreceptor.

11. The apparatus of claim 10 wherein said photoreceptor comprises a plurality of discrete photoreceptor sheets which are sequentially movable in a direction generally perpendicular to the sweep line of the cathode ray tube.

12. Apparatus for image creation comprising a photoreceptor for receiving an electrostatic charge and for forming an electrostatic image upon being exposed to a light image, means for developing said electrostatic image and for transferring the developed image to paper and fixing it thereon, means for transmitting a light image to said photoreceptor, said means being in effective light transmitting relationship with said photoreceptor and including a cathode ray tube light source, and control means for said cathode ray tube to cause selective de-energization of the cathode ray tube beam to form a black on white tube face image for transmission to said photoreceptor.

13. The apparatus of claim 12 wherein the beam of said cathode ray tube sweeps across the face of said tube in a single line and means are provided for moving said photoreceptor in a direction generally perpendicular to the sweep line thereby to provide a two-dimensional light image on said photoreceptor.

14. The apparatus of claim 13 wherein fiber optic light transmitting means are secured in intimate light transmitting relationship with said cathode ray tube and are in effective light transmitting relationship with said photoreceptor.

15. The apparatus of claim 12 wherein said photoreceptor comprises a sheet mounted on an endless belt for movement relative to said means for transmitting a light image to said photoreceptor.

* * * * *